US009217980B2

(12) United States Patent
Sakharshete et al.

(10) Patent No.: US 9,217,980 B2
(45) Date of Patent: Dec. 22, 2015

(54) JAM SENSING AT DOCUMENT FEEDING STATION

(75) Inventors: Swapnil Sakharshete, Rochester, NY (US); David M. Schaertel, Webster, NY (US); Daniel P. Phinney, Rochester, NY (US); Thomas Middleton, Rochester, NY (US)

(73) Assignee: KODAK ALARIS INC., Rochester, NY (US)

( * ) Notice: Subject to any disclaimer, the term of this patent is extended or adjusted under 35 U.S.C. 154(b) by 504 days.

(21) Appl. No.: 13/273,263

(22) Filed: Oct. 14, 2011

(65) Prior Publication Data

US 2013/0093136 A1 Apr. 18, 2013

(51) Int. Cl.
*B65H 7/02* (2006.01)
*G03G 15/00* (2006.01)

(52) U.S. Cl.
CPC ..... *G03G 15/70* (2013.01); *G03G 15/6511* (2013.01); *G03G 15/703* (2013.01); *G03G 2215/00341* (2013.01); *G03G 2215/00548* (2013.01); *G03G 2215/00637* (2013.01)

(58) Field of Classification Search
CPC ..... B65H 7/02; B65H 7/06; B65H 7/12
USPC ..... 271/110, 265.01, 265.04, 262, 263, 271/258.01, 258.02, 259; 270/58.07, 58.08, 270/58.33; 73/159, 587
See application file for complete search history.

(56) References Cited

U.S. PATENT DOCUMENTS

| | | | | |
|---|---|---|---|---|
| 6,182,962 | B1 * | 2/2001 | Leuthold | 271/152 |
| 2006/0182451 | A1 * | 8/2006 | Shoji et al. | 399/9 |
| 2007/0177887 | A1 * | 8/2007 | Haas et al. | 399/17 |
| 2012/0235929 | A1 | 9/2012 | Hongo et al. | |

* cited by examiner

*Primary Examiner* — Thomas Morrison
(74) *Attorney, Agent, or Firm* — Hogan Lovells US LLP

(57) ABSTRACT

A method for preventing damage to a document by a document transport apparatus provides a member for receiving the document as a stack of sheets to be serial fed to a feeding station. At least two spaced-apart microphones are disposed at the feeding station and responsive to audio to produce signals representing audio energy received by each microphone respectively. The energy received from each microphone is compared to determine if it is ambient noise or if it indicates that two attached sheets are being fed or a single sheet is being damaged. The document transport apparatus is shut off to prevent damage to documents when it has been determined that two attached sheets are being fed or that a single sheet is being damaged.

9 Claims, 10 Drawing Sheets

JAM SENSING AT DOCUMENT FEEDING STATION

FIELD OF THE INVENTION

The present invention relates to document handling systems and more particularly to methods and apparatus for sensing document handling problems during the feed and transport cycle.

BACKGROUND OF THE INVENTION

Various types of sensors have been employed for monitoring document handling in imaging apparatus such as scanners, copiers, printers, fax machines, and other equipment that obtains data from, or imprint images and text onto, paper or other sheet media. Automatic document feed systems have used a range of different types of mechanical, optical, and audio sensors for this purpose.

Document feeding stations are particularly prone to problems caused by staples, paperclips, adhesives and other fasteners, poor document preparation or stacking, folds or wrinkles in the fed media sheet, different media weights and thicknesses, and other media-related problems, as well as problems with the media transport components themselves, caused by wear, dust and dirt, and other factors. These problems can be particularly acute with high-speed scanning systems or with scanners that handle financial and other business documents. Failure to detect a jam or other misfeed condition in time can damage the original document, cause loss of data, require special handling to correct the problem, and reduce equipment efficiency due to down time.

With no moving parts, requiring no contact with the moving media, and because they are less susceptible to problems caused by dirt or other particulates, audio sensors have some advantages for use along the media transport path. Audio sensors can perform acceptably when used in place of electrical or optical sensors. However, with conventional solutions in deployment of audio sensors, many of the same problems in document feeding and handling persist.

Thus, it can be seen that there is a need for improved apparatus and methods for detecting document feed problems and helping to prevent damage to documents due to misfeeds and jams.

SUMMARY OF THE INVENTION

Embodiments of the present invention are directed to advancing the art of document feeding and handling in an imaging apparatus. An arrangement of audio sensors helps to detect jams and misfeeds at the document feeding station in a timely manner, enabling the media transport apparatus to stop before further damage to the document occurs and, optionally, signaling an error condition to an operator.

According to an aspect of the present invention, there is provided a method for preventing damage to a document by a document transport apparatus, comprising a) providing a member for receiving the document as a stack of sheets to be serial fed to a feeding station;

b) providing at least two spaced-apart microphones disposed at the feeding station and responsive to audio to produce signals representing audio energy received by each microphone respectively;

c) comparing the energy received from each microphone to determine if it is ambient noise or if it indicates that two attached sheets are being fed or that a single sheet is being damaged; and d) shutting off the document transport apparatus to prevent damage to documents when it has been determined that two attached sheets are being fed or a single sheet is being damaged.

These and other aspects, objects, features and advantages of the present invention will be more clearly understood and appreciated from a review of the following detailed description of the preferred embodiments and appended claims, and by reference to the accompanying drawings.

BRIEF DESCRIPTION OF THE DRAWINGS

The foregoing and other objects, features, and advantages of the invention will be apparent from the following more particular description of the embodiments of the invention, as illustrated in the accompanying drawings, in which.

DETAILED DESCRIPTION OF THE INVENTION

Figure 1:
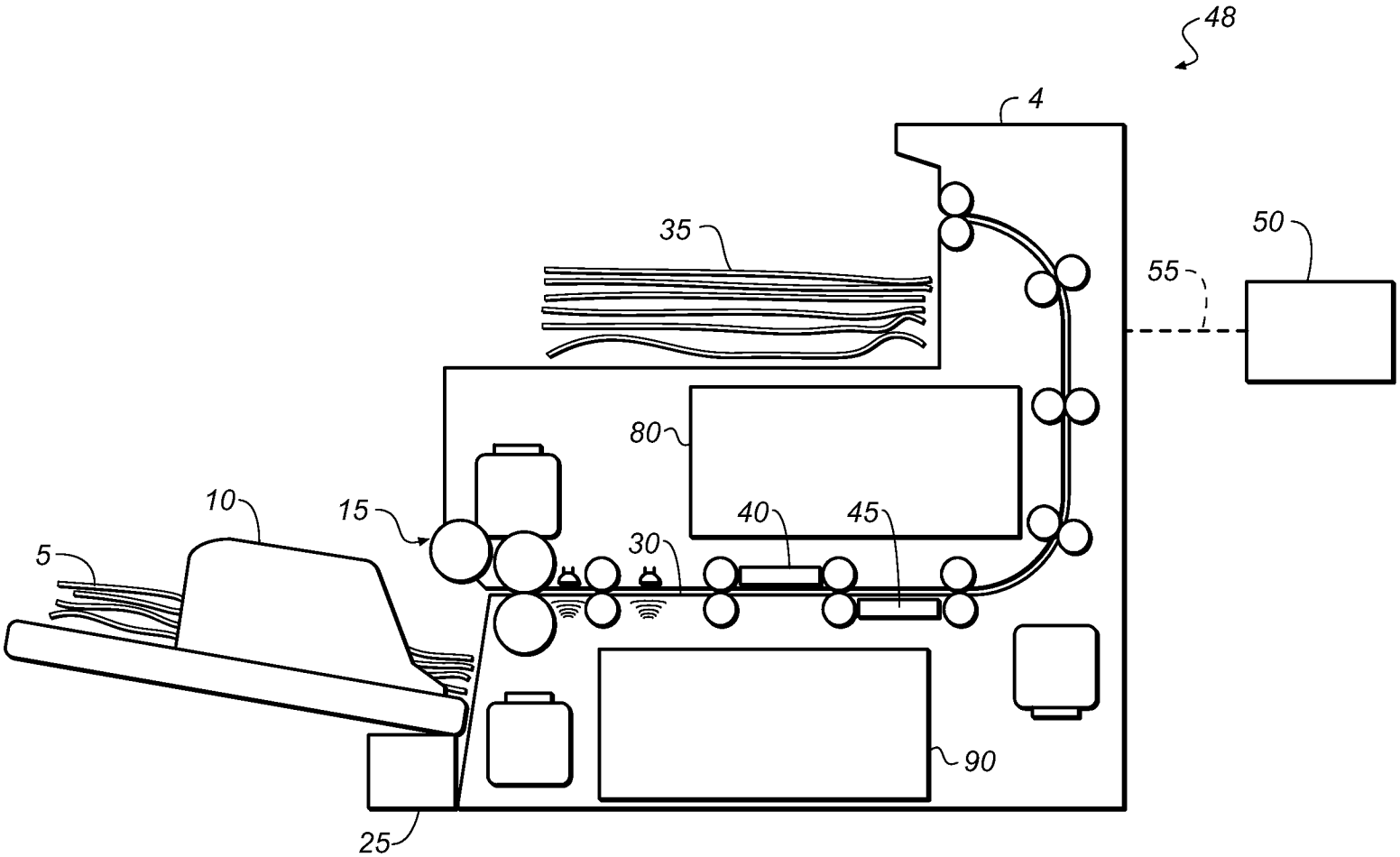
FIG. 1 is a side cross-sectional view of a document scanner that uses the document feed apparatus sensing according to an embodiment of the present invention.

In the following detailed description of embodiments of the present invention, reference is made to the drawings in which the same reference numerals are assigned to identical elements in successive figures. It should be noted that these figures are provided to illustrate overall functions and relationships according to embodiments of the present invention and are not provided with intent to represent actual size or scale.

Embodiments of the present invention address the problem of document feed monitoring and jam detection using an arrangement of audio sensors that cooperate to indicate that a problem has occurred. As noted previously in the background section, audio sensing has advantages over other types of sensing mechanisms, such as those that require contact with the moving document. There are, however, problems peculiar to audio sensing, such as the requirement to distinguish sounds indicating a jam or feed problem from ambient noise from outside the document handling system as well as from noise due to document handling system components themselves. Unlike conventional approaches that merely replace mechanical or optical sensors with audio equivalents, embodiments of the present invention take advantage of signal differences among multiple audio sensors and are thus capable of obtaining more accurate information about the nature and source of document feed problems than is available using conventional sensor solutions. As a result, a jam condition is more accurately detected and corrective action initiated to help prevent further damage to the document as it enters the media transport path.

In the context of the present embodiment, the terms "microphone" and "audio transducer" are used interchangeably to describe a component that provides an analog or digital output signal according to an audio input signal.

The description that follows references an exemplary document handling and transport system that is used in a digital scanner. It should be noted that the apparatus and methods of the present invention can also be used with document handling equipment for imaging apparatus and equipment of other types, such as those used for copiers, fax machines, printers, binding devices, and other systems. The document feed tray, or other member for receiving the document as a stack of serial-fed sheets, can include single-sheet feed, top feed, bottom feed, or other serial feed configurations. Particular arrangements of rollers, feed mechanisms, and other document handling components can vary significantly from those described below.

FIG. 1 is a side cross-sectional view of one type of imaging apparatus, a document scanner 4, showing portions of a document transport apparatus 48. As shown in FIG. 1, documents 5 are fed into scanner 4 in serial form from an input tray 10 of scanner 4. When documents 5 enter scanner 4, urge rollers, feed rollers, and separation rollers of a document feed station, document feed apparatus 15, urge the document 5 from input tray 10, separating the documents 5 from one another, and direct the document 5 down a media transport path 30 and past scanning elements 40 and 45. The newly scanned document then proceeds along transport path 30 until it is ejected onto an output stack 35. As shown in FIG. 1, input tray 10 can include documents that have some amount of folds or wrinkles. An elevator 25 lifts input tray 10 into vertical position for serial document feeding.

Audio Sources and Sensing

Figure 2A:
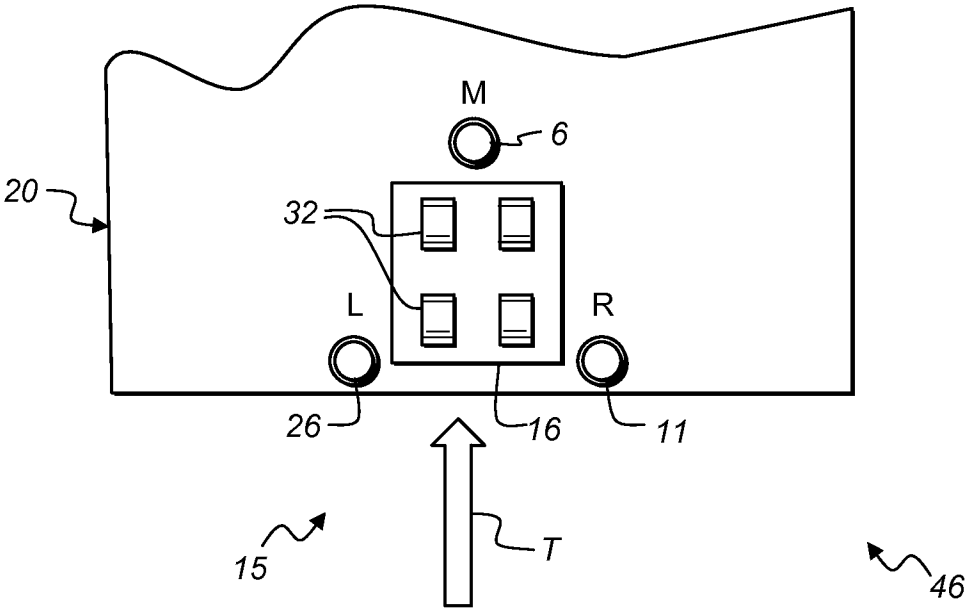
FIG. 2A is a top view of the document feed apparatus and sensors according to an embodiment of the present invention.

The action of various document transport apparatus components in operation, such as separation rollers of document feed apparatus 15 in separating the documents 5 from one another, generates sound that is characterized and used to sense normal operation or to indicate some type of document handling problem. In the case of a stapled, paper clipped, adhesively fastened, or jamming document, for example, separation roller handling produces a wrinkling sound that is characteristically different from the sound that is produced when an unwrinkled, well-preserved document enters scanner 4. Referring to the top view of a document feeding station 46 in FIG. 2A, with travel direction T indicated from the front of the scanner 4 or other document feed apparatus 15, the sounds of the document 5 are picked up by an arrangement of microphones or other audio transducers 26, 11, and 6, with corresponding microphone positions marked L (left), R (right) and M (middle), that are part of a document feed sensing apparatus 20. Feed rollers 32 are shown as part of a feed roller apparatus 16 and schematically represent any of a number of roller types, including rollers for document urging and separation. The obtained audio signal 55 (FIG. 1) is sent to be conditioned, digitized, and processed on a digital signal processing (DSP) platform 50 (FIG. 1). DSP platform 50 can be any of a number of types of digital processors for processing the audio signals from audio transducers 26, 11, and 6. Suitable processors for the DSP function can include microprocessors or other dedicated processors, programmable logic devices, or a local or networked computer or computers that respond to programmed instructions to analyze the audio data and provide one or more suitable output signals, which signals can include data content or can be analog signals.

Figure 2B:
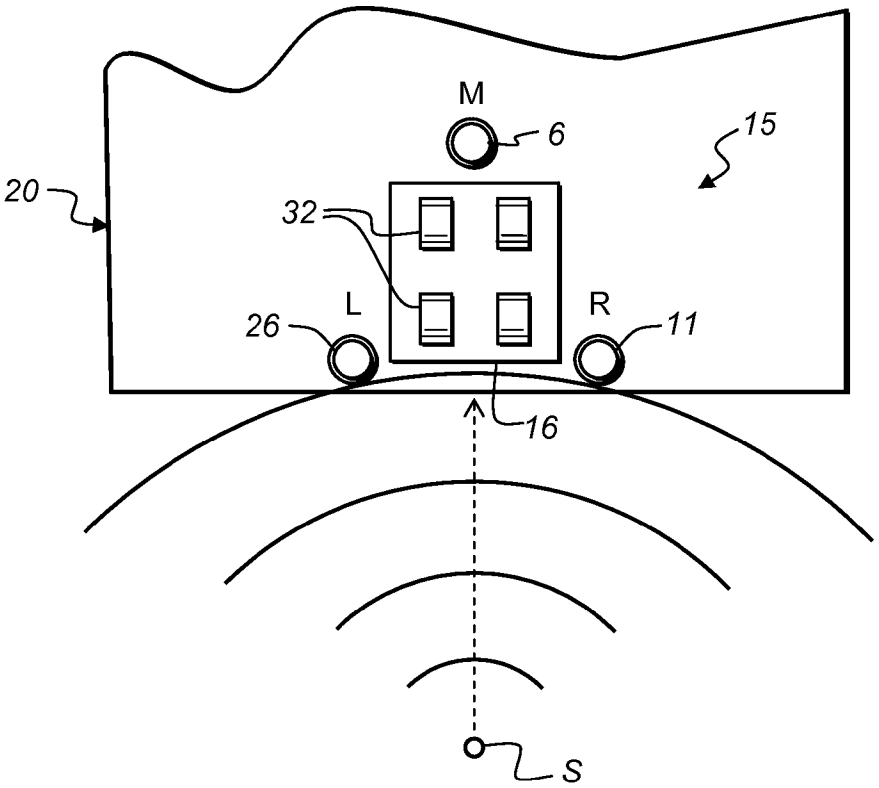
FIG. 2B is a top view of the document feed apparatus and sensors showing characteristics of an audio signal having the same amplitude at each left and right microphone.

The particular arrangement of audio transducers 6, 11 and 26 at L, R, and M positions is provided in order to help to detect and filter out ambient noise and to sense proper operation of document feeding. Ambient sound coming from the front of the scanner (at 0° incidence) will be detected equally at L and R positions and a cross correlation between the signals coming from the corresponding audio transducers 11 and 26 will yield a high value of cross-correlation coefficient around the $0^{th}$ lag. The top view of FIG. 2B shows how sound emanating from a source S that is in front of the document feed sensing apparatus 20 strikes both L and R front microphones, audio transducers 26 and 11, equally. This is similar to the sensed signal arrangement with ambient sound, such as sound from an office environment in which a scanner or other document handling apparatus is used, for example. That is, broadly-distributed ambient sound is indicated by generally equal audio signals at L and R microphones.

Figure 2C:
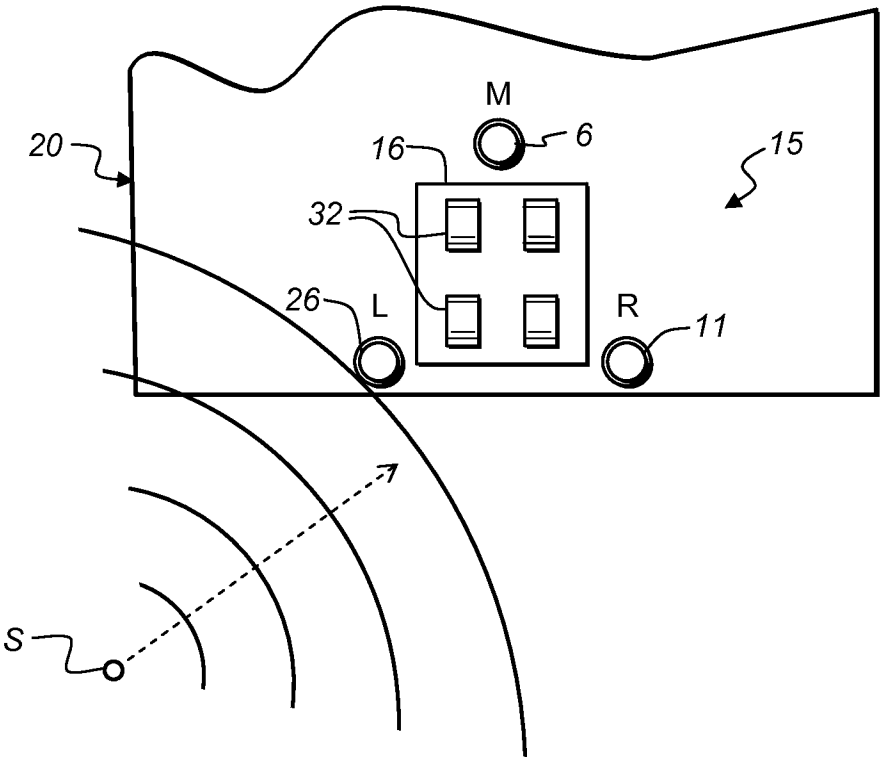
FIG. 2C is a top view of the document feed apparatus and sensors showing characteristics of an audio signal having different amplitudes at left and right microphones.

The top view of FIG. 2C shows an alternate case, in which sound appears to emanate from one side, shown as the left side in this example, or the other. Here, the sound signal appears to emanate from source S at about 45 degrees from the front of document feed sensing apparatus 20. This can be due to ambient sound from one side of the unit or to document handling sound along one side of the document feed path input, for example.

Cross-Correlation

Embodiments of the present invention use cross-correlation to help determine whether or not detected noise is ambient noise and to help to differentiate ambient noise from document handling noise. Well known to those skilled in the signal processing arts, cross-correlation gives a measure of how similar two signals are, as a function of the time lag between them. In execution, cross-correlation sums the product of two signals where they overlap. For signals from microphones at L and R, cross-correlation processing tests by shifting one signal past the other to determine where the computed correlation is highest.

Figure 3A:
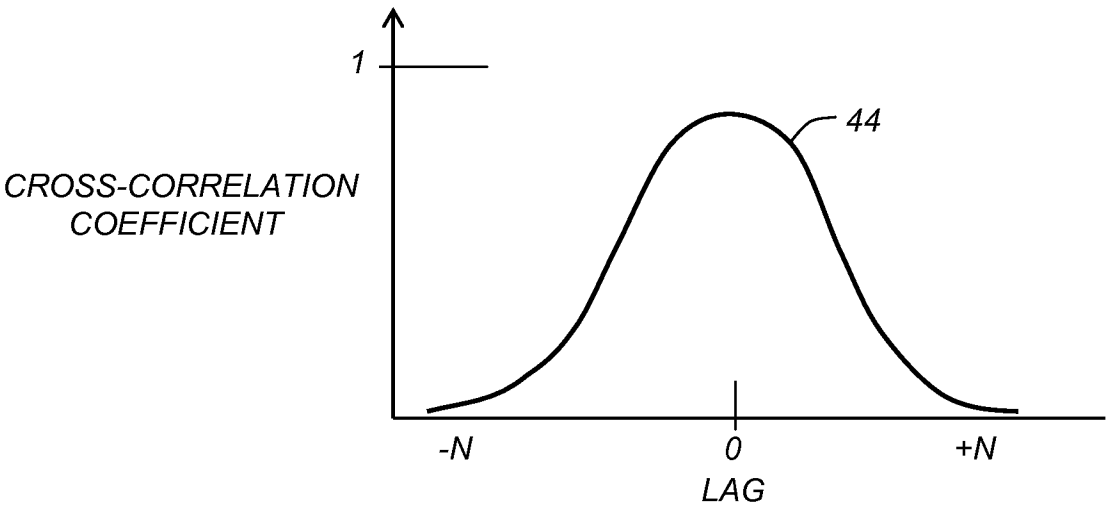
FIG. 3A is a graph showing cross-correlation with reference to the example of FIG. 2B.
Figure 3B:
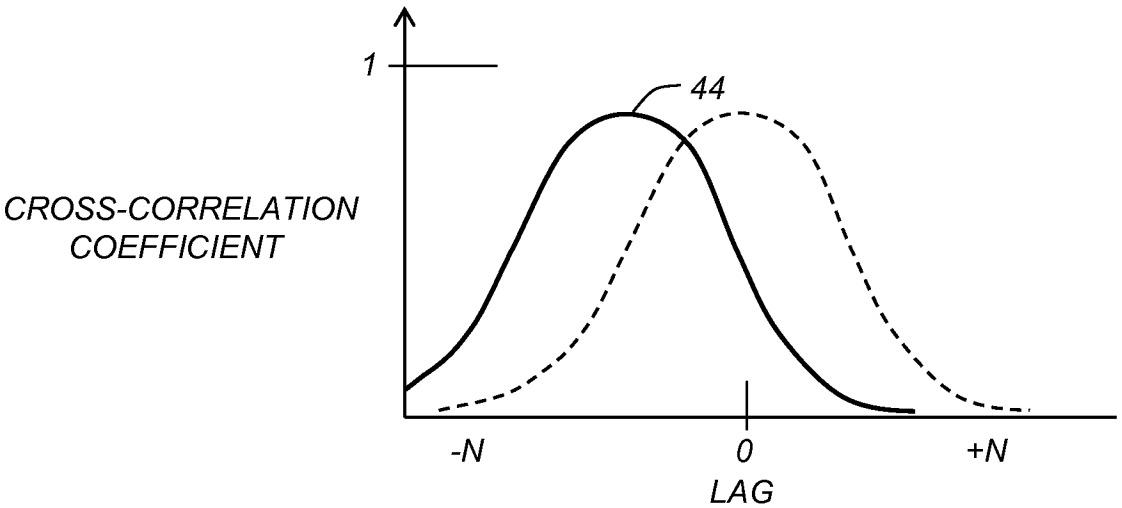
FIG. 3B is a graph showing cross-correlation with reference to the example of FIG. 2C.

The graph of FIG. 3A shows a cross-correlation curve 44 for two audio signal frames that are substantially identical, such as in the example of FIG. 2B. Here, the peak of cross-correlation curve 44 shows 0 lag between the compared signals. This type of cross-correlation, with near-zero lag, is common for ambient signal detection. By comparison, the graph of FIG. 3B shows a negative cross-correlation curve 44 that corresponds to the signal sensing condition of FIG. 2C. The absolute value of the cross-correlation peak remains high; only the lag (by some sample value) indicates the difference between signals.

To improve comparison between L and R microphone channels, the cross-correlation coefficient is normalized by dividing it by an auto-correlation coefficient that relates a microphone's output to itself. This helps to reduce the microphone's effect on the data, permitting the underlying characteristics of the audio signal to be compared on a common scale.

Where cross-correlation is below a predetermined correlation threshold, as described in subsequent procedures, the two L and R microphones are not capturing signals from the same audio source. This indicates, for example, a staple, paperclip, adhesive or other problem that is near one or the other microphone. Where cross-correlation exceeds the correlation threshold, on the other hand, the L and R microphones are assumed to be capturing the same noise.

Audio Detection and Processing Sequence

Referring again to FIG. 2A, where there is a staple along a trail edge or rear edge of the document 5, the document 5 first gets pulled into the scanner 4 until the feed rollers 32, used as separation rollers in the described embodiment, attempt to un-staple the document 5. This document un-stapling happens very close to either microphone at L or R, depending on the position of the staple; hence the jamming sound is pronounced at one of the L or R positions, corresponding to the staple location, and weak at the other position. As described previously, the cross-correlation between the signals from the two L/R microphones in this case will have a lower peak value around the $0^{th}$ lag, and thus the sound source for handling the document is identified.

In the event that both jam sound and ambient sounds are present, further signal processing is helpful. In this case, adaptive filtering is performed, with the selected L/R microphone channel as primary signal and the other channel as reference signal, to help isolate and remove the ambient sound from the jam sound. The detailed description of this signal processing is given subsequently.

Consistent with an embodiment of the present invention, the algorithm for jam detection is a frame based-processing technique that works on a frame of some number N of audio samples at a time from the L, R, or M audio transducers 26, 11 and 6. Initially, the algorithm receives one frame from each L, R and M microphone and it selects one microphone at a particular instant for further processing, based on the highest energy detected in these sampled frames. Since ambient sound approaching the scanner 4 is always received first at L or R microphones, by the time the ambient sound reaches the middle M microphone, its energy is correspondingly reduced. Hence, when middle microphone M has the highest energy of all the frames and is then selected, it is sent on for further processing, to determine whether or not this indicates a jam condition. Because of its position within the scanner 4, the middle microphone M is neither used to measure ambient sound nor involved in the determination of the sound source, as described previously.

Advantageously, methods of the present invention are able to adjust transducer sensitivity as the medium advances from the input tray 10 and begins to move to positions along transport path 30. For example, the algorithm also accommodates noise associated with entry of the trail edge of the document into document transport path 30 (FIG. 1). During this time, as the document falls from a higher level of elevator 25 (FIG. 1) to a lower level on the document transport path 30, a sharp impulse occurs in the audio signal 55. This impulse is similar to the sound made by a rear stapled document being separated at the trail edge. Microphones at L and R positions, because they are located toward the input tray 10 and are generally directed outward to detect ambient and input tray sound, do not readily detect this impulse, since the sound is generated behind these microphones relative to the media path. Instead, the middle microphone at M detects this sound. To help avoid false positives in the jam detection system due to this noise, the sensitivities to signals from the microphones at L, R, and M are varied as the document travels along the document transport path 30 (FIG. 1). Change in microphone or signal sensitivity and how this is used is described in more detail subsequently.

Figure 4:
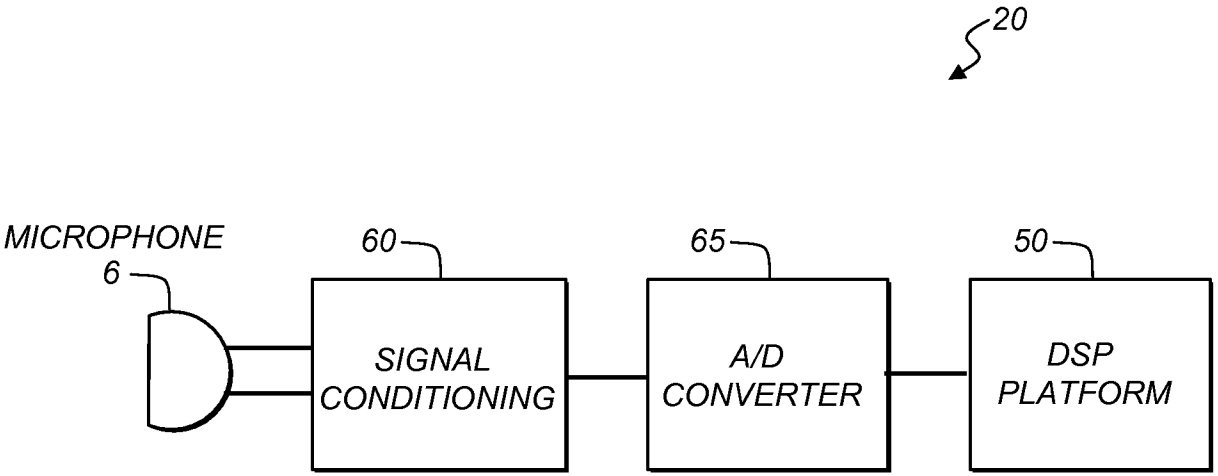
FIG. 4 is a schematic block diagram that shows the audio signal path in the document feed sensing apparatus.

The audio signal path for each of audio transducers 6, 11, and 26 is designed to condition the audio signal 55 and to provide a corresponding digital signal to DSP platform 50 for analysis. As shown in FIG. 4, audio transducer 6 (or other transducer 11 or 26) provides a signal to a signal conditioning circuit 60 that provides filtering to remove noise and can further condition the signal for subsequent processing. The conditioned analog signal is then sampled and digitized by an analog to digital A/D converter 65 at an appropriate rate to avoid aliasing of the highest frequency present in the signal. A/D converter 65 then provides this data to DSP platform 50. DSP platform 50 provides an output signal that indicates jam detection. This signal can then be used to stop document feed apparatus 15 or to stop transport rollers or other components that otherwise conduct the document 5 along media transport path 30 and, optionally, to provide a warning, such as by energizing an indicator light, for example.

Embodiments of the present invention differentiate between the sound made by a normal paper sheet entering the document scanner 4 and a wrinkling sound made by the paper in case of jam. In this system, it is useful to ignore or in some way to isolate background sounds of the scanner 4 or other document handling device from the wrinkling or jamming sounds. Normal background sounds come from different moving parts of the scanner, such as the transport motor, fan, clutch, front and rear lamp, and elevator. These background sounds are periodic and have low frequency components. On the other hand, the audio signal from a wrinkling document, is a short duration signal in the time domain, has frequency components spread over a wide range in the frequency domain. Therefore, computing the energy of the audio signal 55 in a band between two frequencies F1 and F2, and assuming that the sound from the background and from a clean document 5 entering the scanner 4 has frequencies concentrated below F1, differentiation is made between normal scanning of documents and an event in which a document starts to jam.

Another aspect of this system is to ignore ambient background sound typical of an office environment, such as sound from people talking, music playing, and other normal workplace sounds that can occur near the scanner. To avoid interference of these sounds with the working of the algorithm, multiple audio sensors are placed inside the scanner in such a way that the system can reliably detect jams occurring near the feeder area by discriminating expected sounds from those that indicate a jam.

Figure 5:
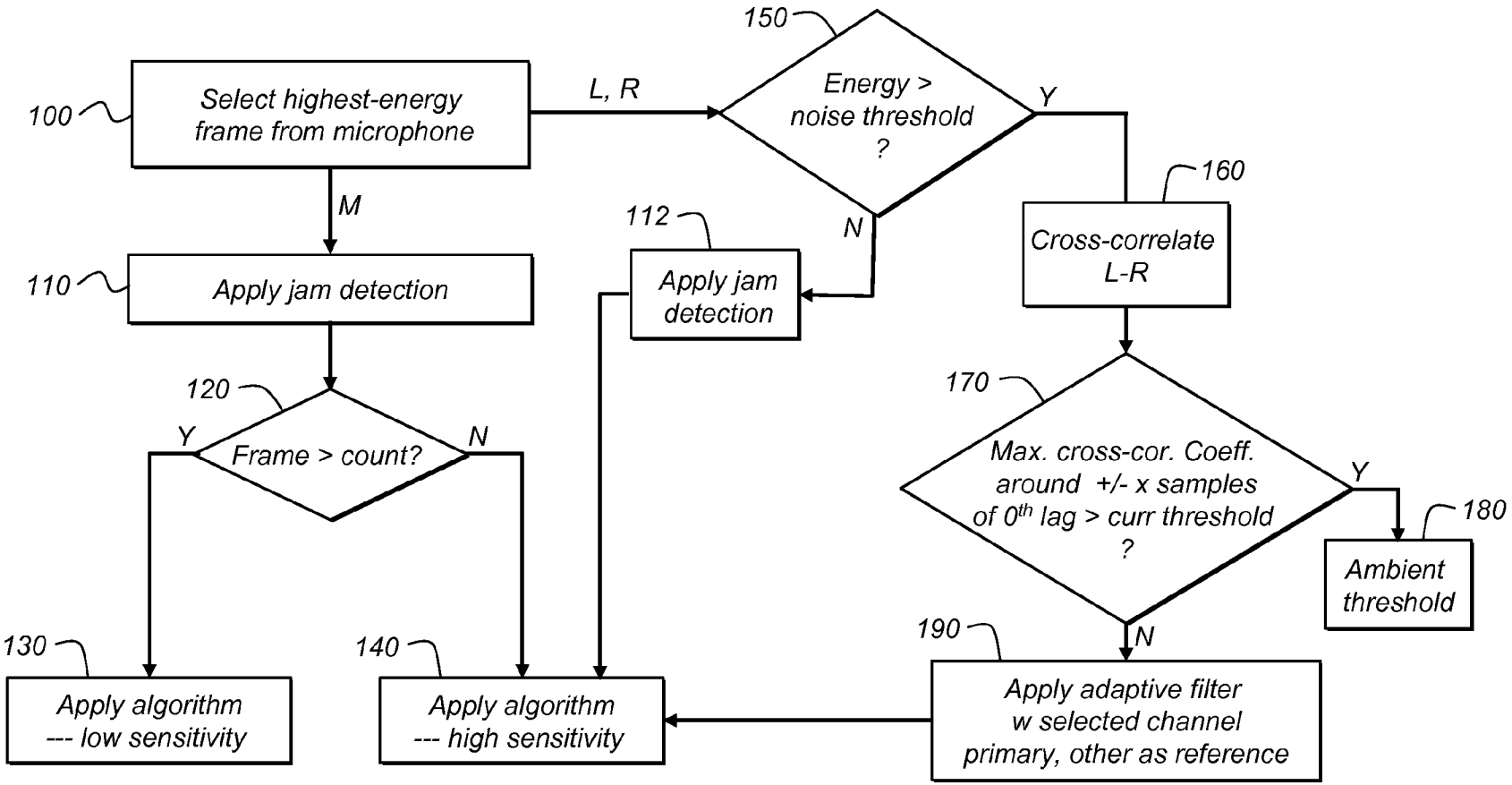
FIG. 5 is a logic flow diagram that shows audio frame processing according to an embodiment of the present invention.

FIG. 5 is a logic flow diagram that shows how the N audio frames are processed according to an embodiment of the present invention. A selection step 100 selects the highest energy frame, whether from either microphone at positions L and R or from middle microphone M. Having the highest energy indicates the strongest audio signal at that particular audio transducer. Consistent with one embodiment of the present invention, selection step 100 uses the following formula for each microphone channel to obtain the largest absolute average:

$$\left(\sum_{1}^{N} \mathrm{abs}(mic_{data})\right) \Big/ N$$

If middle microphone M is selected, a leading-edge jam (e.g., due to a staple, paper clip, adhesive, or other fastener in the front) or a misfeed is more likely, most readily detected due to positioning of the microphone at this point. If microphone M is selected, a jam detection process 110 is initiated. Jam detection process 110 works through a number of sub-steps in order to determine whether or not a jam is detected. It is useful to establish how far the document 5 has progressed from the input tray 10 and into the transport path 30. This is determined by simply counting the number of audio frames obtained for this document. A decision step 120 compares the frame count against a threshold value for sensitivity switching, termed a Sensitivity Switch Point (SSP) in one embodiment of the present invention. A count above the SSP value indicates, for example, that the document has progressed further than the first few inches into the transport path 30. If this is the case, an algorithm application step 130 with low sensitivity is executed, as shown in FIG. 5. If the document has not yet progressed this far, an alternate algorithm application step 140 with high sensitivity is executed.

As used for this purpose, 'SSP' relates to the number of samples corresponding to the time taken by the smallest length document, that can be fed to the scanner, to enter the document transport from the elevator:

$$SSP=Fs*L/S$$

Where, Fs—Sampling frequency in Hz

L—Length of smallest document specified for a particular scanner in inches

S—Speed of the media transport in inches/s.

This check is useful to help compensate for the impulse noise associated with the microphone position M, when the trail edge of the document enters the document transport.

Thus, in embodiments of the present invention, the sensitivities of microphones at L, R, and M are adjusted according to the position of the medium in the media transport path, with transitions timed appropriately. When the document is initially fed into the transport path 30, with up to about 4-5 inches fed into the transport path 30, middle microphone M has high sensitivity. As the media moves further along beyond that point, sensitivity changes so middle microphone M then has low sensitivity. With this adjustment, it is possible to improve the response of document feed sensing apparatus 20 to jams and misfeed problems at different points in the document feed cycle. Document feed sensing apparatus 20 can include a way for adjusting the sensitivity of one or more of the audio signals, such as the sensitivity of the middle audio signal, according to the length of the document. Sensitivity adjustment are performed by signal conditioning circuit 60, for example, as shown in FIG. 4.

Along the alternate execution path in the logic flow of FIG. 5, an audio frame from microphones at L or R might exhibit the highest energy. This high audio average signal can indicate ambient noise or some problem with a document fastened, for example by staples, paper clips, or adhesive, along its trailing edge. If the frame is from left microphone L, energy from right microphone R is compared with an energy based noise threshold (termed the Absolute_Ambient_thresh or Ambient_thresh according to one embodiment of the present invention) in a decision step 150. In the case of ambient sound, energy from the right microphone R signal is higher than this Absolute_Ambient_thresh value, since ambient sound is arriving at both the microphones. A normalized cross correlation, with its value ranging between 0 and 1, is performed on the left microphone L signal and on the right microphone R signal. The maximum value (or peak) of the cross-correlation coefficient around +/−X samples of 0th lag is compared to a set threshold (termed corr_thresh in this example). Corr_thresh can be set to 0.5, indicating a 50% confidence level. A correlation coefficient at or above 0.5 indicates that the two input signals are similar or well correlated, as that terminology is used in the present disclosure. A correlation coefficient below this threshold value indicates input signals that are not well correlated. The value of X can be calculated by knowing the system parameters as:

$$X=Fs*D/S$$

Wherein, Fs—sampling frequency in Hz;

D—Distance between left and right microphone in m;

S—Speed of sound in air m/s.

Hence, depending on the direction left or right from which the ambient sound is approaching the microphones, the peak of the cross-correlated signal shifts correspondingly left or right of the $0^{th}$ lag, by X samples respectively.

Continuing with the processing shown in FIG. 5, the particular frame, whether L or R, is processed in subsequent steps. If a decision step 150 determines that the energy is less than the Ambient_thresh threshold value, the frame is sent for further processing, as indicated by a jam detection process 112. Here again, entry into jam detection process 112 does not indicate that a jam exists; further processing is needed to determine this. Results are passed to an algorithm application step 140 with high sensitivity since the frame is either from L or R microphone. If decision step 150 determines that that the energy exceeds the threshold, the cross-correlation of frames for L and R microphones is performed in step 160, as noted above. Another decision step 170 checks the cross-correlation coefficient against the corr_thresh value described previously. If this is in excess of this threshold, the audio energy is determined to be from ambient noise 180 and the corresponding audio frame is ignored. If less than this threshold, an adaptive filter step 190 is executed on the selected channel and execution passes to algorithm application step 140.

When there is a staple, paperclip, adhesive or other fastener on the left trailing edge of the document 5 and ambient sound is also present, the energy from right microphone exceeds the Absolute_Ambient_thresh value and the left microphone L signal does not correlate with the right microphone R signal. The peak value of cross correlation step 160 is below the corr_thresh value. In this example, both signals are given to the adaptive filter in step 190 with the left microphone L acting as primary signal and right microphone R acting as reference signal.

Using the method of the present invention, not only can a jam condition be detected, but the location of the problem can also be identified in many cases. This capability permits document feed sensing apparatus 20 to both stop feeding the document 5 from the input tray 10 and report the location of the problem, whether along the leading or trailing edge and whether on the left or right side of the document 5. Document feed sensing apparatus 20 generates an output signal that is used to energize a control panel indicator or provide an electronic message that indicates the likely problem source.

Figure 6:
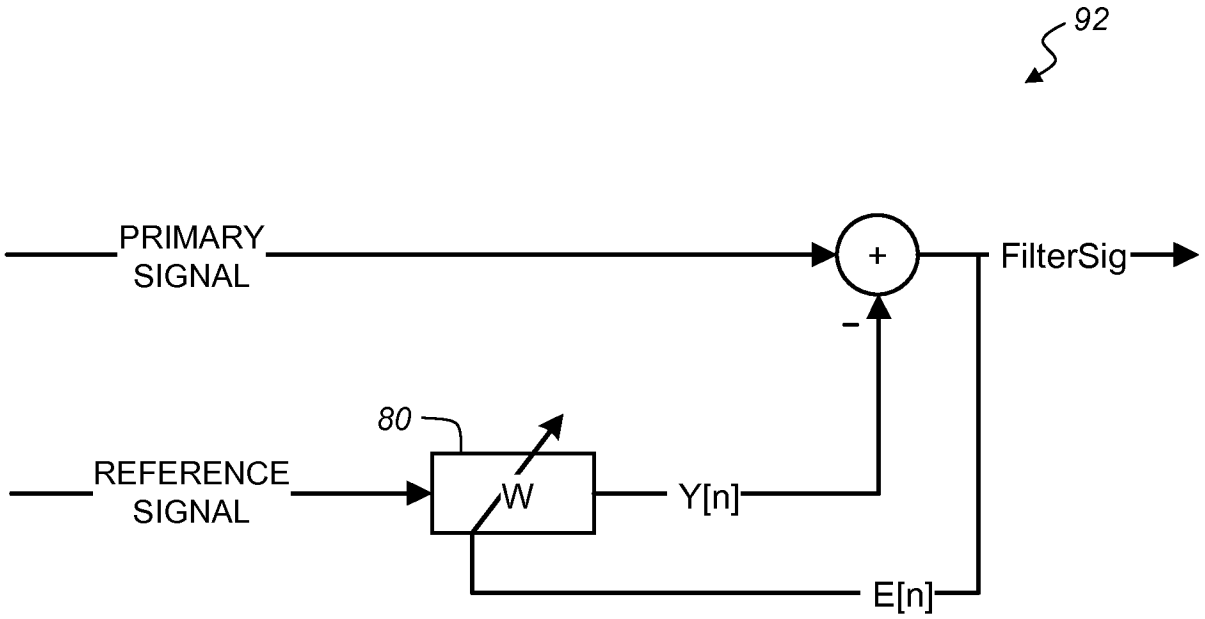
FIG. 6 is a schematic block diagram showing an adaptive audio filter.

The schematic block diagram of FIG. 6 shows an adaptive filter 92. The objective of the adaptive filter is to change (adapt) the coefficients of an FIR (Finite Impulse Response) filter, W 80, so that the reference signal matches as closely as possible the response of the filter system, Y. The filtered signal from the adaptive filter is free from the ambient sound and is passed on for further processing by the algorithm.

It is appreciated that the logic flow shown in FIG. 5 can be executed in different ways and can be modified and adapted to suit the requirements and problems of a particular document handling system. General principles that have been found to be of particular value for jam detection when using the multiple audio transducer arrangement of FIG. 2A include the following:

(i) Processing of the highest energy frame(s). Jam or misfeed noise is most likely to be detected in the highest energy frame or frames.

(ii) Cross-correlation to compare L and R microphone signals. Where these signals are very similar, cross-correlation increases and ambient noise is assumed, as noted earlier.

(iii) Additional data is collected. Because the process of FIG. 5 is executed quickly, there is time to repeat processing with an updated set of N frames. This capability can help to reduce ambiguity in jam detection.

Figure 7:
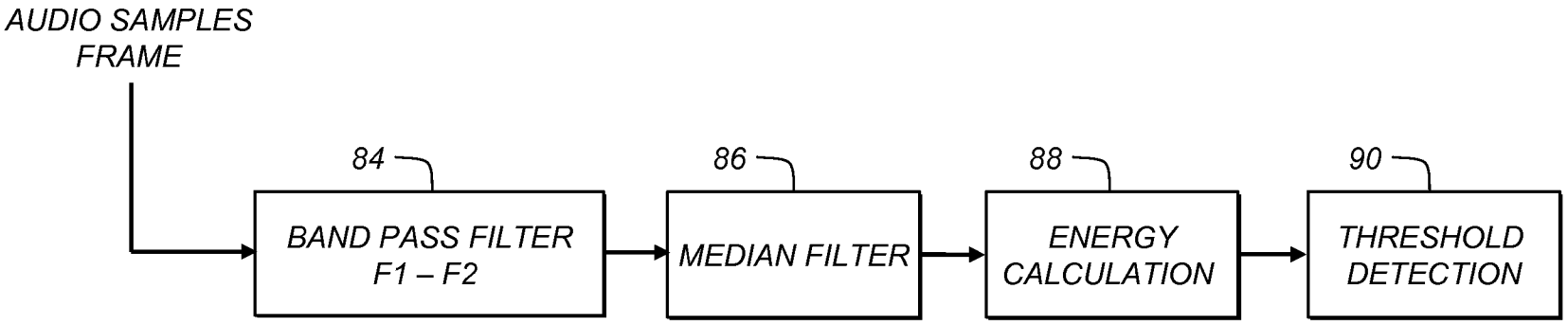
FIG. 7 is a logic flow diagram that shows execution of jam detection and algorithm application.

The logic flow diagram of FIG. 7 shows the execution used for jam detection steps 110 and 112 and algorithm application steps 130 and 140 according to an embodiment of the present invention. The selected audio frame first goes to a band pass filter 84 with cut-off frequencies from F1 to F2. Cut-off frequency F1 is selected such that the background sound from different moving parts of the scanner or other device and the sound associated with a document in good condition is fed into the scanner lie below this cut-off value. In one embodiment of the present invention, cut-off frequency F1 is approximately 1000 Hz. F2 is the upper frequency of a document that is jamming or wrinkling. Frequencies above F2 are not related to document handling. Ambient noise is broadly distributed in terms of frequency and spans the full range of frequencies up to and beyond F2.

A median filter 86 is used to help avoid any false jam detection, such as what might occur if a pre-wrinkled or folded document were fed to the scanner. By comparing the audio signals for a wrinkling document (true jam) and a pre-wrinkled document, an observation can be made that the audio signal for the wrinkled document has intermittent high peak values as against an actively wrinkling document that has continuous high values of amplitude as the paper starts to jam. Thus, applying a 1D median filter to the audio signal of the incoming document helps to reduce the effect of intermittent spikes and thus reduce the potential false jam detection. After passing the audio frame through filters 84 and 86, energy of this filtered signal is calculated in an energy calculation step 88 and compared with a threshold in a threshold detection step 90 to determine if it indicates a jam or a "clean" document, that is, a document in good condition that fed properly into the scanner or other device.

One problem that is addressed by embodiments of the present invention relates to differences in sound that are characteristic of the location of the trailing edge of the document 5 along the transport path 30. A page separation mechanism or other device along the transport path 30 can be the cause of a sound impulse that is normal, but can be misinterpreted, as the document sheet moves past. To help reduce the effects of this type of normal sound variation, embodiments of the present invention adjust the sensitivity of detection logic to the audio signal 55 according to relative location along the media transport path. Position along the transport path is determined, for example, by maintaining a count of audio frames obtained for a document.

The invention has been described in detail with particular reference to presently preferred embodiments, but it will be understood that variations and modifications can be effected that are within the scope of the invention. For example, adjustment of sensitivity to audio signals can be obtained in a number of ways, such as by attenuating the signal obtained by the corresponding microphone or by conditioning digital data from the received signal. The presently disclosed embodiments are therefore considered in all respects to be illustrative and not restrictive. The scope of the invention is indicated by the appended claims, and all changes that come within the meaning and range of equivalents thereof are intended to be embraced therein.

4 Document scanner
5 Document
6 Audio transducer
10 Input tray
11 Audio transducer
15 Document feed apparatus
16 Feed roller apparatus
20 Document feed sensing apparatus
25 Elevator
26 Audio transducer
30 Transport path
32 Feed roller
35 Output stack
40 Scanning element
45 Scanning element
44 Correlation curve
46 Document feeding station
48 Document transport apparatus
50 DSP platform
55 Audio signal
60 Signal conditioning circuit
65 A/D converter
80 FIR filter
84 Band pass filter
86 Median filter
88 Energy calculation step
90 Threshold detection step
92 Adaptive filter
100 Selection step
110 Jam detection process
112 Jam detection process
120 Decision step
130 Algorithm application step
140 Algorithm application step
150 Decision step
160 Cross-correlation step
170 Decision step
180 Ambient noise
190 Adaptive filter step
S Source
T Travel direction
L Left
R Right
M Middle
W Filter
Y Filter System

The invention claimed is:

1. A method for preventing damage to a document by a document transport apparatus, comprising a) providing a member for receiving the document as a stack of sheets to be serial fed to a feeding station;

b) providing at least two spaced-apart microphones disposed at the feeding station and responsive to audio to produce signals representing audio energy received by each microphone respectively;

c) cross-correlating the signals received from the at least two microphones to determine that there is ambient noise or that there are at least two attached sheets being fed or there is a single sheet being damaged, wherein the sheets in the document are attached by staples, paperclips, or adhesives; and d) shutting off the document transport apparatus to prevent damage to documents based upon a determination that at least two attached sheets are being fed or that a single sheet is being damaged.

2. The method according to claim 1 further including providing a third microphone in the document transport apparatus, the third microphone spaced apart from the first and second microphones along a media transport path and responsive to audio to produce signals representing audio energy received.

3. The method according to claim 1 further including reporting a document handling problem.

4. The method according to claim 1 further including reporting a document handling problem.

5. The method of claim 1, wherein providing the at least two microphones includes providing a left microphone and right microphone, and further comprising determining the presence of at least two attached sheets when the signal from the left microphone does not correlate with the signal from the right microphone.

6. A method for preventing damage to a document by a feeding station, comprising a) providing a member for receiving a stack of sheets to be serial fed to the feeding station;

b) providing at least two spaced-apart microphones disposed at the feeding station and responsive to audio to produce signals representing audio energy received by each microphone respectively;

c) cross-correlating the signals received from the at least two microphones to determine that there is ambient noise or that there are at least two attached sheets being fed or that there is a single sheet being damaged, wherein the sheets are attached by staples, paperclips, or adhesives; and d) shutting off the feeding station to prevent damage to documents based upon a determination that at least two attached sheets are being fed or that a single sheet is being damaged.

7. The method according to claim 6 wherein the sheets are wrinkling due to a problem with feeding or transporting the sheets.

8. The method according claim 6 wherein well correlated signals represent ambient noise and, when the microphone signals are not well correlated with the attachment of at least two sheets or when a single sheet is being damaged.

9. The method of claim 6, wherein providing the at least two microphones includes providing a left microphone and right microphone, and further comprising determining the presence of at least two attached sheets when the signal from the left microphone does not correlate with the signal from the right microphone.

* * * * *